US007407002B2

(12) United States Patent
Jang et al.

(10) Patent No.: US 7,407,002 B2
(45) Date of Patent: Aug. 5, 2008

(54) AIR CONDITIONER AND OUTDOOR UNIT THEREFOR

(75) Inventors: Sae-Dong Jang, Gyeonggi-Do (KR); Il-Nahm Hwang, Gyeonggi-Do (KR); Jin-Seob Song, Gyeonggi-Do (KR); Bong-Soo Park, Seoul (KR); Dong-Jun Yang, Seoul (KR); Ho-Jong Jeong, Seoul (KR)

(73) Assignee: LG Electronics Inc., Seoul (KR)

( * ) Notice: Subject to any disclaimer, the term of this patent is extended or adjusted under 35 U.S.C. 154(b) by 243 days.

(21) Appl. No.: 10/720,212

(22) Filed: Nov. 25, 2003

(65) Prior Publication Data

US 2004/0226711 A1 Nov. 18, 2004

(30) Foreign Application Priority Data

May 1, 2003 (KR) ..... 10-2003-0028045

(51) Int. Cl.
*F25B 29/00* (2006.01)

(52) U.S. Cl. ..... 165/240; 165/231; 62/238.7

(58) Field of Classification Search ..... 165/240, 165/231, 58; 62/160, 238.7
See application file for complete search history.

(56) References Cited

U.S. PATENT DOCUMENTS

| | | | | |
|---|---|---|---|---|
| 3,293,874 | A * | 12/1966 | Gerteis | 62/160 |
| 4,644,756 | A | 2/1987 | Sugimoto et al. | |
| 4,646,537 | A | 3/1987 | Crawford et al. | |
| 4,766,734 | A * | 8/1988 | Dudley | 62/238.7 |
| 4,798,059 | A * | 1/1989 | Morita | 62/238.7 |
| 5,105,629 | A | 4/1992 | Parris et al. | |
| 5,211,023 | A | 5/1993 | Matsuura | |
| 5,673,570 | A | 10/1997 | Sada | |
| 5,685,168 | A | 11/1997 | Sada | |

FOREIGN PATENT DOCUMENTS

| | | |
|---|---|---|
| EP | 0473286 | 3/1992 |
| EP | 0715132 | 6/1996 |
| JP | 1-300169 | 12/1989 |
| JP | 10-281597 | 10/1998 |
| JP | 11-108507 | 4/1999 |

OTHER PUBLICATIONS

English Language Abstract of JP 1-300169.
English Language Abstract of JP 11-108507.
English Language Abstract of JP 10-281597.

* cited by examiner

*Primary Examiner*—Ljiljana (Lil) V Ciric
(74) *Attorney, Agent, or Firm*—Greenblum & Bernstein, P.L.C.

(57) ABSTRACT

An air conditioner comprises an outdoor unit and an indoor unit provided with an indoor heat exchanger and an indoor expansion device, wherein the outdoor unit comprises a compressor for compressing a refrigerant, an outdoor heat exchanger for heat-exchanging a refrigerant, a four-way valve adjacently arranged to the compressor for circulating a refrigerant discharged from the compressor according to a heating cycle or a cooling cycle, a refrigerant detouring path for detouring a refrigerant discharged from the outdoor heat exchanger to the compressor at the time of a defrosting operation, an outdoor expansion device installed in the middle of the detouring path for reducing a pressure of a refrigerant which flows in the refrigerant detouring path, and a heat exchanging device installed in the middle of the detouring path for heat-exchanging between a refrigerant introduced from the outdoor expansion device and a refrigerant discharged from the compressor.

11 Claims, 5 Drawing Sheets

AIR CONDITIONER AND OUTDOOR UNIT THEREFOR

BACKGROUND OF THE INVENTION

1. Field of the Invention

The present invention relates to an air conditioner performing heating or cooling by using a heat pump cycle, and more particularly, to an air conditioner provided with an outdoor unit and performing its own defrosting operation at the time of heating.

2. Description of the Conventional Art

Generally, an air conditioner is a device for controlling temperature, humidity, current, and cleanliness of air for comfortable indoor circumstances. By a construction of a unit, the air conditioner is divided into an integral type air conditioner for accommodating both an indoor unit and an outdoor unit in a single case, and a separated type air conditioner for constituting a compressor and a condenser as an outdoor unit and constituting an evaporator as an indoor unit. Addition to this, there is an air conditioner for both heating and cooling which can selectively perform heating and cooling by switching a refrigerant path with a four-way valve.

Recently, a multi-type air conditioner provided with a plurality of indoor units for heating or cooling according to each indoor space is being used. The multi-type air conditioner is provided with a plurality of compressors or a plurality of outdoor units connected to each other in parallel in order to effectively perform heating or cooling correspondingly to the number of the indoor units.

FIG. 1 is a schematic view showing one embodiment of an air conditioner in accordance with the conventional art. As shown, the conventional air conditioner is divided into an indoor unit 11 and an outdoor unit 21, and the indoor unit 11 is composed of an indoor heat exchanger 13 for heat-exchanging a refrigerant indoors and an indoor expansion device 15 for depressurization-expanding a refrigerant.

The outdoor unit 21 is composed of a compressor 23 for compressing refrigerant gas, an outdoor heat exchanger 33 for heat-exchanging a refrigerant with external air, a four-way valve 31 adjacently arranged to the compressor 23 for circulating a compression refrigerant discharged from the compressor 23 according to a heating cycle or a cooling cycle, an accumulator 35 arranged at an inlet of the compressor 23 for filtering a liquefied refrigerant, a first refrigerant path 41 for connecting the outdoor heat exchanger 33 to the indoor unit 11, and a second refrigerant path 42 for connecting the four-way valve 31 to the indoor unit 11.

Also, an oil separator 22 for separating oil, an oil returning path 29 for recycling oil separated by the oil separator 22 into the compressor 23, and a check valve 27 for preventing a backflow of a refrigerant are installed between an outlet of the compressor 23 and the four-way valve 31.

A receiver 37 for temporarily receiving a refrigerant and a drier 39 for removing moisture included in a refrigerant are installed in the middle of the first refrigerant path 41, and service valves 45*a* and 45*b* are respectively installed at the first and second refrigerant paths 41 and 42.

Both heating and cooling are operated in said conventional air conditioner. First, in case of the cooling operation, a refrigerant compressed in the compressor 23 is introduced into the outdoor heat exchanger 33 by an operation of the four-way valve 31, and the refrigerant which has passed through the outdoor heat exchanger 33 is introduced into the indoor expansion device 15 and the indoor heat exchanger 13 of the indoor unit 11 through the first refrigerant path 41. Also, the refrigerant which has passed through the indoor unit 11 is introduced into the four-way valve 31 through the second refrigerant flow 42, and the refrigerant which has passed through the four-way valve 31 passes through the accumulator 35 thus to be introduced into the compressor 23. Accordingly, by said cooling cycle of a refrigerant, the cooling operation of the air conditioner is performed.

Also, in case of the heating operation, a refrigerant compressed in the compressor 23 passes through the indoor expansion device 15 and the indoor heat exchanger 13 of the indoor unit 11 through the second refrigerant path 42 by the four-way valve 31, and a refrigerant discharged from the indoor unit 11 is introduced into the outdoor heat exchanger 33 through the firs refrigerant path 41. The refrigerant which has passed through the outdoor heat exchanger 33 passes through the four-way valve 31 and the accumulator 35 thus to be introduced into the compressor 23. Accordingly, by said heating cycle of a refrigerant, the heating operation of the air conditioner is performed.

Meanwhile, during the heating operation, frost is generated on a surface of the outdoor heat exchanger 33, and in order to remove the frost, the heating operation is periodically stopped and a defrosting operation is performed. A defrosting cycle of a refrigerant for performing the defrosting operation is formed of a reverse cycle of the heating cycle like the cooling cycle.

FIG. 2 is a schematic view showing another embodiment of the air conditioner in accordance with the conventional art. As shown, a plurality of outdoor units 21 having the same structure as the aforementioned embodiment are installed in parallel in order to enhance efficiency of the air conditioner in case that a great cooling/heating capacity is required. Also, each outdoor unit 21 is connected to main paths 48 and 47 for introducing and discharging a refrigerant into the indoor unit 11 thus to perform cooling and heating operations.

In said conventional air conditioner, a refrigerant which has performed the defrosting operation of the outdoor heat exchanger 33 passes through the indoor expansion device 15 and the indoor heat exchanger 13 of the indoor unit 11. Accordingly, when the defrosting operation is performed after stopping the heating operation, a refrigerant which circulates through the indoor expansion device 15 and the indoor heat exchanger 13 during the heating operation is at once reversely circulated thus to cause noise of the indoor unit 11.

Moreover, in case that a plurality of the outdoor units 21 of the air conditioner are arranged, when one outdoor unit 21 among the plurality of outdoor units 21 performs the defrosting operation, the heating operation of all the outdoor units 21 has to be stopped and the defrosting operation has to be simultaneously performed. Accordingly, the heating operation of the plurality of indoor units 11 connected to the outdoor units 21 is all stopped thus to generate indoor heat loss.

SUMMARY OF THE INVENTION

Therefore, an object of the present invention is to provide an air conditioner capable of preventing noise generated indoors by preventing a refrigerant from being introduced into an indoor unit by constituting a defrosting cycle so that a refrigerant can circulate in an outdoor unit itself at the time of a defrosting operation of the outdoor unit, and an outdoor unit therefor.

Another object of the present invention is to provide an air conditioner capable of consecutively performing a heating operation of an indoor unit and preventing an indoor heat loss by constructing each outdoor unit to separately perform defrosting and heating operations in case that a plurality of outdoor units are arranged by preventing a refrigerant from being introduced into the indoor unit by constructing a defrosting cycle so that the refrigerant can circulate in the outdoor unit itself at the time of defrosting operation of the outdoor unit, and an outdoor unit therefor.

To achieve these and other advantages and in accordance with the purpose of the present invention, as embodied and broadly described herein, there is provided an air conditioner comprising an outdoor unit and an indoor unit provided with an indoor heat exchanger and an indoor expansion device, wherein the outdoor unit comprises a compressor for compressing a refrigerant; an outdoor heat exchanger for heat-exchanging a refrigerant; a four-way valve adjacently arranged to the compressor for circulating a refrigerant discharged from the compressor according to a heating cycle or a cooling cycle; a refrigerant detouring path for detouring a refrigerant discharged from the outdoor heat exchanger to the compressor at the time of a defrosting operation; an outdoor expansion device installed in the middle of the detouring path for reducing a pressure of a refrigerant which flows in the refrigerant detouring path; and a heat exchanging device installed in the middle of the detouring path for heat-exchanging between a refrigerant introduced from the outdoor expansion device and a refrigerant discharged from the compressor.

To achieve these and other advantages and in accordance with the purpose of the present invention, as embodied and broadly described herein, there is also provided an outdoor unit for an air conditioner comprising a compressor; an outdoor heat exchanger for heat-exchanging a refrigerant with external air; a four-way valve adjacently arranged to the compressor for circulating a refrigerant according to a heating cycle or a cooling cycle; a first refrigerant path for connecting the outdoor heat exchanger to an indoor unit; a second refrigerant path for connecting the four-way valve to the indoor unit; a refrigerant detouring path connected to the first refrigerant path by a first three-way valve and connected to the second refrigerant path by a second three-way valve for detouring a refrigerant at the time of a defrosting cycle; an outdoor expansion device installed in the middle of the refrigerant detouring path for lowering a pressure of a refrigerant which flows in the refrigerant detouring path; and a heat exchanging device installed between the outdoor expansion device and the second three-way valve, for heat-exchanging a refrigerant discharged from the compressor and a refrigerant which has passed through the outdoor expansion device.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

An outdoor unit for an air conditioner according to the present invention will be explained hereinafter.

Figure 1:
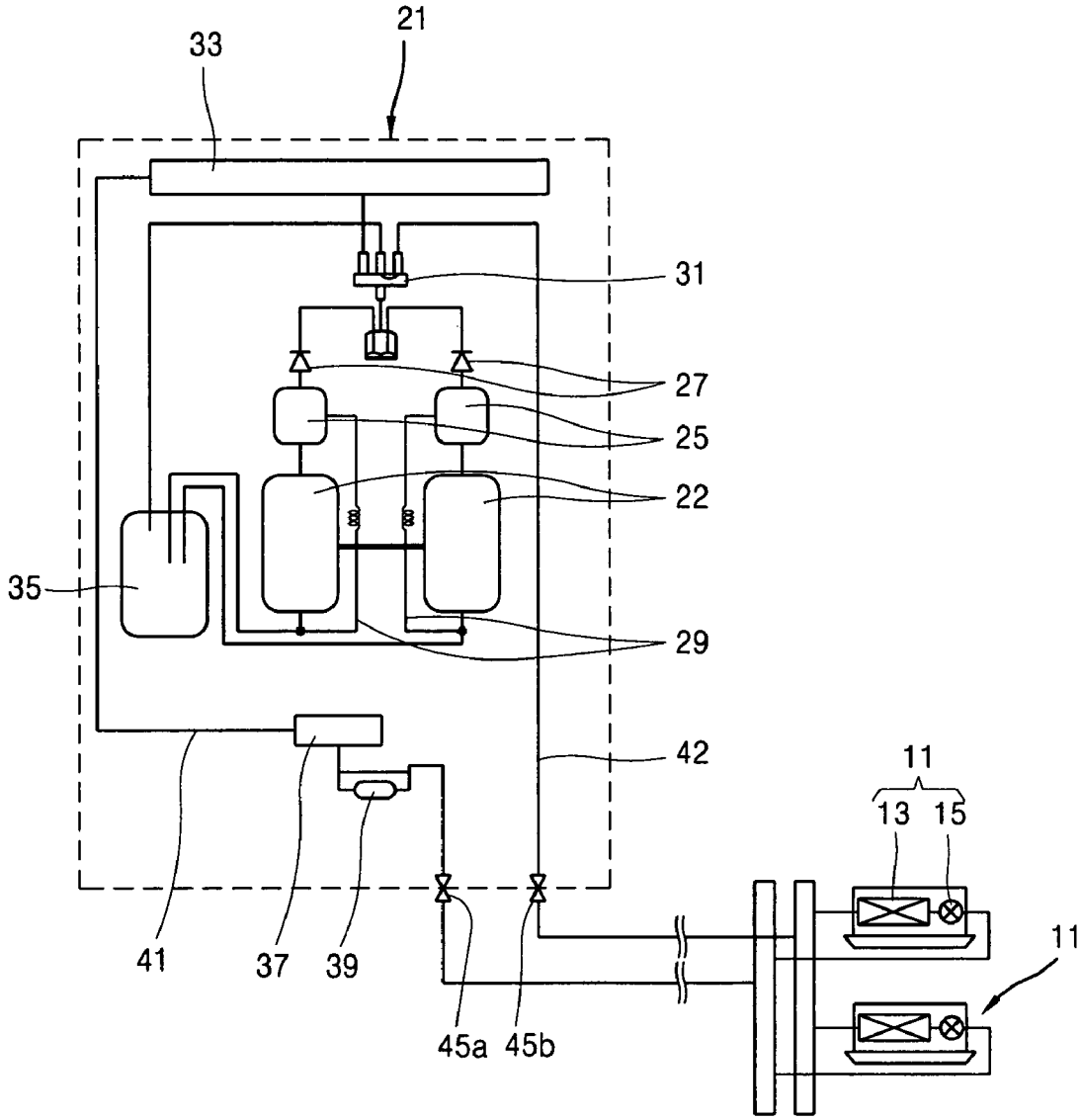
FIG. 1 CONVENTIONAL ART
FIG. 1 is a schematic view showing one embodiment of an air conditioner in accordance with the conventional art.
Figure 2:
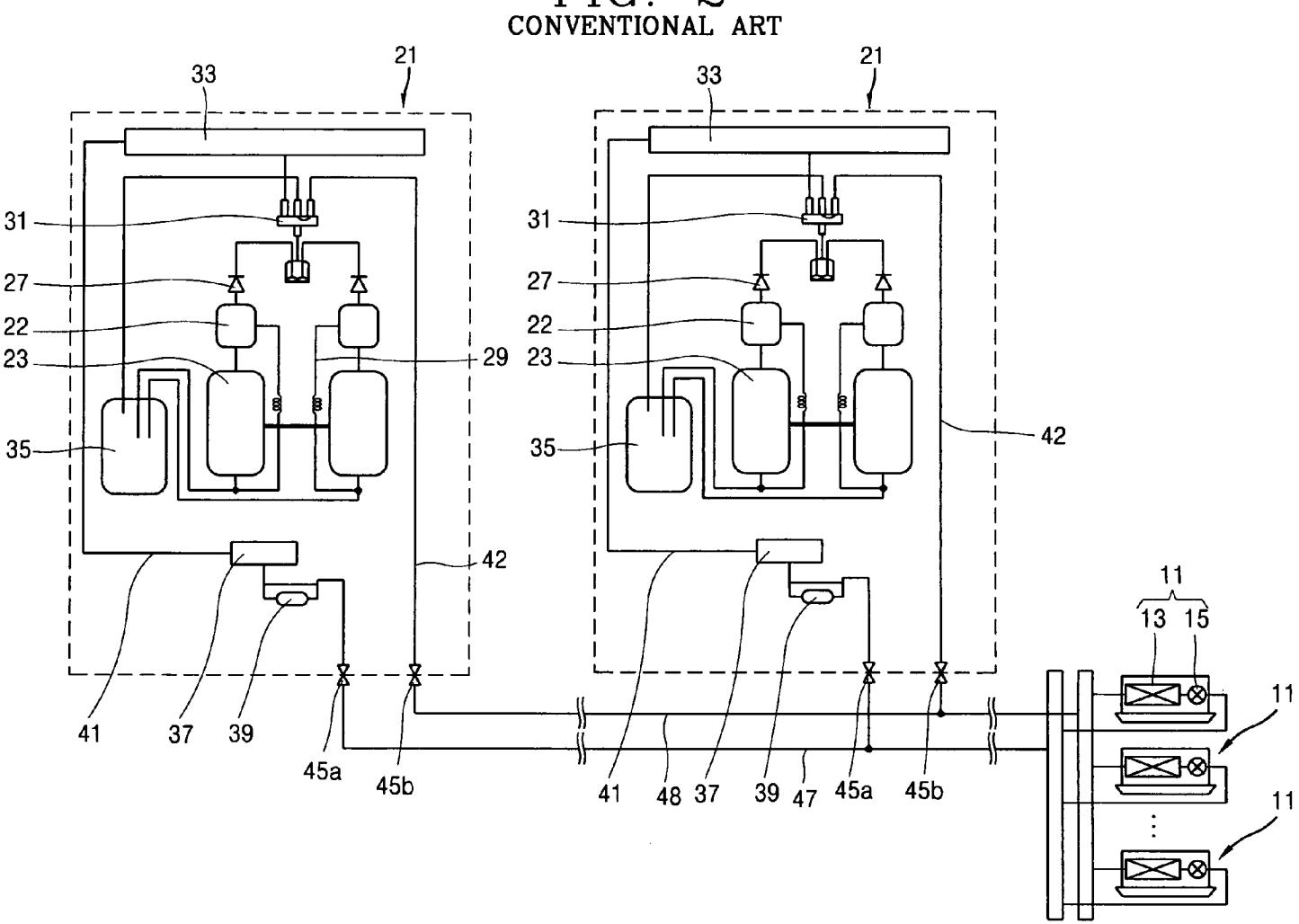
FIG. 2 CONVENTIONAL ART
FIG. 2 is a schematic view showing another embodiment of the air conditioner in accordance with the conventional art.
Figure 3:
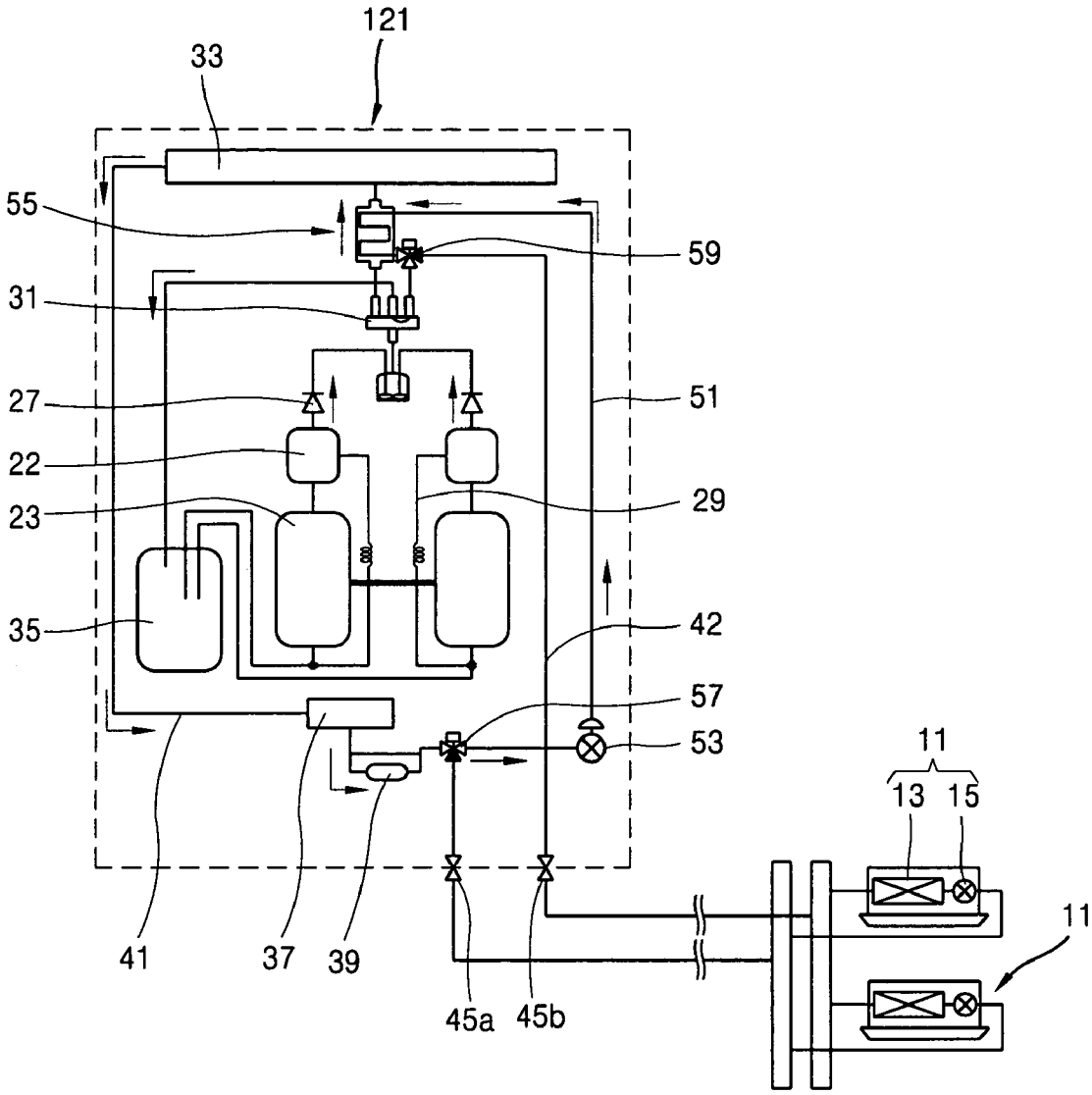
FIG. 3 is a schematic view showing one embodiment of an air conditioner according to the present invention.

As shown in FIG. 3, the air conditioner according to one embodiment of the present invention is composed of a plurality of indoor units 11 constituted with an indoor heat exchanger 13 for heat-exchanging a refrigerant and an indoor expansion device 15 and arranged in parallel, and an outdoor unit 121. The outdoor unit 121 and the indoor units 11 are connected to each other by a connection pipe.

The outdoor unit 121 comprises a compressor 23 for compressing refrigerant gas, an outdoor heat exchanger 33 for heat-exchanging a refrigerant with external air, a four-way valve 31 adjacently arranged to the compressor 23 for circulating a refrigerant according to a heating cycle or a cooling cycle, an accumulator 35 arranged at an inlet of the compressor 23 for filtering a liquefied refrigerant, a first refrigerant path 41 for connecting the outdoor heat exchanger 33 to an indoor unit 11, a second refrigerant path 42 for connecting the four-way valve 31 to the indoor unit 11, a refrigerant detouring path 51 connected to the first refrigerant path 41 by a first three-way valve 57 and connected to the second refrigerant path 42 by a second three-way valve 59 for detouring a refrigerant at the time of a defrosting cycle, an outdoor expansion device 53 installed in the middle of the refrigerant detouring path 51 for lowering a pressure of a refrigerant which flows in the refrigerant detouring path 51, and a heat exchanging device 55 installed between the outdoor expansion device 53 and the second three-way valve 57 for heat-exchanging between a refrigerant introduced to the outdoor heat exchanger 33 from the four-way valve 31 and a refrigerant which has passed through the outdoor expansion device 53.

The heat exchanging device 55 is formed of a heat conducting coil which winds the refrigerant detouring path 51, and the outdoor expansion device 53 is formed of an electron expansion valve.

Also, an oil separator 22 for separating oil, an oil returning path 29 for recycling oil separated by the oil separator 22 into the compressor 23, and a check valve 27 for preventing a backflow of a refrigerant are installed between an outlet of the compressor 23 and the four-way valve 31.

A receiver 37 for temporarily receiving a refrigerant and a drier 39 for removing moisture included in a refrigerant are installed in the middle of the first refrigerant path 41, and service valves 45*a* and 45*b* are respectively installed at the first and second refrigerant paths 41 and 42.

Figure 4:
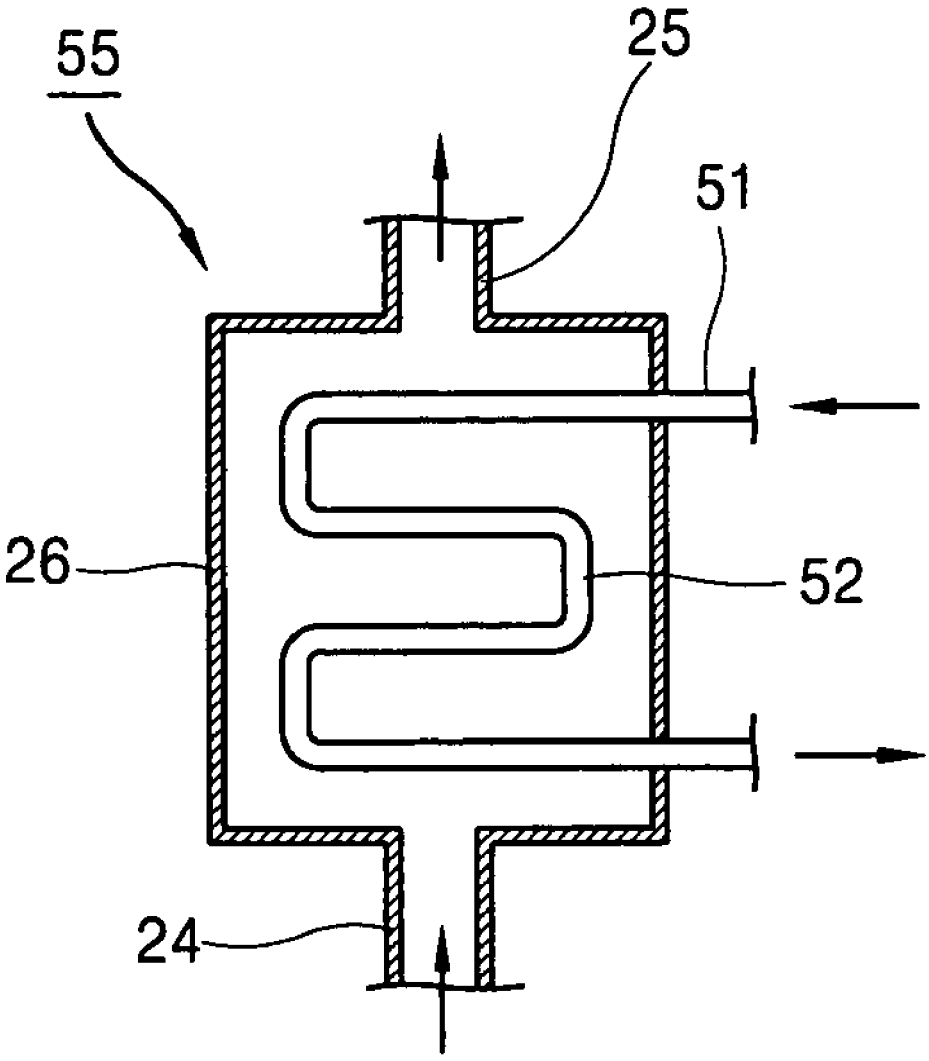
FIG. 4 is a sectional view showing a heat exchanging device of the air conditioner according to one embodiment of the present invention.

The heat exchanging device 55, as shown in FIG. 4, includes an inlet portion 24 for introducing a refrigerant from the four-way valve 31, a heat exchanging portion 26 extending from the inlet portion 24 with an expanded volume and for accommodating the refrigerant detouring path 51 therein, and an outlet portion 25 for discharging a refrigerant which has passed through the heat exchanging portion 26 to the outdoor heat exchanger 33.

Herein, the refrigerant detouring path 51 is preferably formed as a curved pipe 52 of a zigzag shape in the heat exchanging portion 26 so that the refrigerant which has passed through the outdoor expansion device 53 and the refrigerant discharged from the compressor 23 can be smoothly heat-exchanged in the heat exchanging portion 26 of the heat exchanging device 55.

The outdoor expansion device 53 is preferably formed of an electron expansion valve.

In the air conditioner according to the present invention, a refrigerant path is changed by a position control of the four-way valve 31, thereby performing heating and cooling cycles. That is, at the time of the cooling cycle of the air conditioner, a refrigerant compressed in the compressor 23 passes through the four-way valve 31 thus to be introduced into the outdoor heat exchanger 33. Then, the refrigerant passes through the indoor expansion device 15 and the indoor heat exchanger 13 through the first refrigerant path 41, and then passes through the four-way valve 31 and the accumulator 35 through the second refrigerant path 42 thus to be introduced into the compressor 23.

Also, the heating cycle of the air conditioner is performed as a reverse cycle of the cooling cycle. That is, the refrigerant compressed in the compressor 23 passes through the second refrigerant path 42 by an operation of the four-way valve 31, and the refrigerant discharged from the indoor unit 11 is introduced into the outdoor heat exchanger 33 through the first refrigerant path 41. Also, the refrigerant which has passed through the outdoor heat exchanger 33 passes through the four-way valve 31 and the accumulator 35 thus to be introduced into the compressor 23.

At the time of the heating cycle, a defrosting cycle for removing frost generated at the heat exchanger 33 is operated. The defrosting cycle is performed similarly to the cooling cycle, but the refrigerant which has passed through the outdoor heat exchanger is not introduced into the indoor unit through the first refrigerant path but passes through the refrigerant detouring path by the first and second three-way valves 57 and 59 thus to be introduced into the compressor 23.

That is, at the time of the defrosting cycle, the refrigerant compressed in the compressor 23 passes through the four-way valve 31 thus to be introduced into the outdoor heat exchanger 33, and the refrigerant discharged from the outdoor heat exchanger 33 passes through the first refrigerant path 41 and the first three-way valve 57 thus to be introduced into the refrigerant detouring path 51. At this time, the refrigerant is not introduced into the indoor unit 11 by the first three-way valve 57. Also, the refrigerant which has passed through the first three-way valve 57 passes through the outdoor expansion device 53 and the heat exchanging device 55 and passes through the second three-way valve 59 thus to be introduced into the four-way valve 31. At this time, the refrigerant is not introduced into the second refrigerant path 42 by the second three-way valve 59. Also, the refrigerant which has been introduced into the four-way valve 31 passes through the accumulator 35 thus to be introduced into the compressor 23. In said defrosting cycle, the outdoor expansion device 53 and the heat exchanging device 55 serve as the indoor heat exchanger 13 and the indoor expansion device 15 of the indoor unit 11.

In the air conditioner according to one embodiment of the present invention, since the refrigerant which has passed through the outdoor heat exchanger 33 is not introduced into the indoor unit 11 but passes through the outdoor expansion device 53 and the heat exchanging device 55 by the refrigerant detouring path 51 thus to circulate in the compressor 23 at the time of the defrosting cycle, a noise generated from the indoor unit 11 is prevented.

Also, since the heat exchanging device 55 is provided with a simple structure that the refrigerant which has passed through the outdoor expansion device 53 and the refrigerant discharged from the compressor 23 are heat-exchanged to each other, heat exchange can be smoothly performed without an additional component such as a refrigerant heating device.

Hereinafter, the outdoor for an air conditioner according to another embodiment of the present invention will be explained with reference to FIG. 5. The same reference numerals will be given to the same components as those of the aforementioned one embodiment and their explanations will be omitted.

The air conditioner according to another embodiment of the present invention comprises a plurality of outdoor units 121 and 221 respectively including the compressor 23 and the outdoor heat exchanger 33 and arranged in parallel, and a plurality of indoor units 11 including the indoor heat exchanger 13 and the indoor expansion device 15 and arranged in parallel. Also, each outdoor unit is connected to each other through main paths 48 and 47 for introducing and discharging a refrigerant into the indoor units 11. The respective outdoor units 121 and 221 have similar structures and operations to the aforementioned one embodiment.

Figure 5:
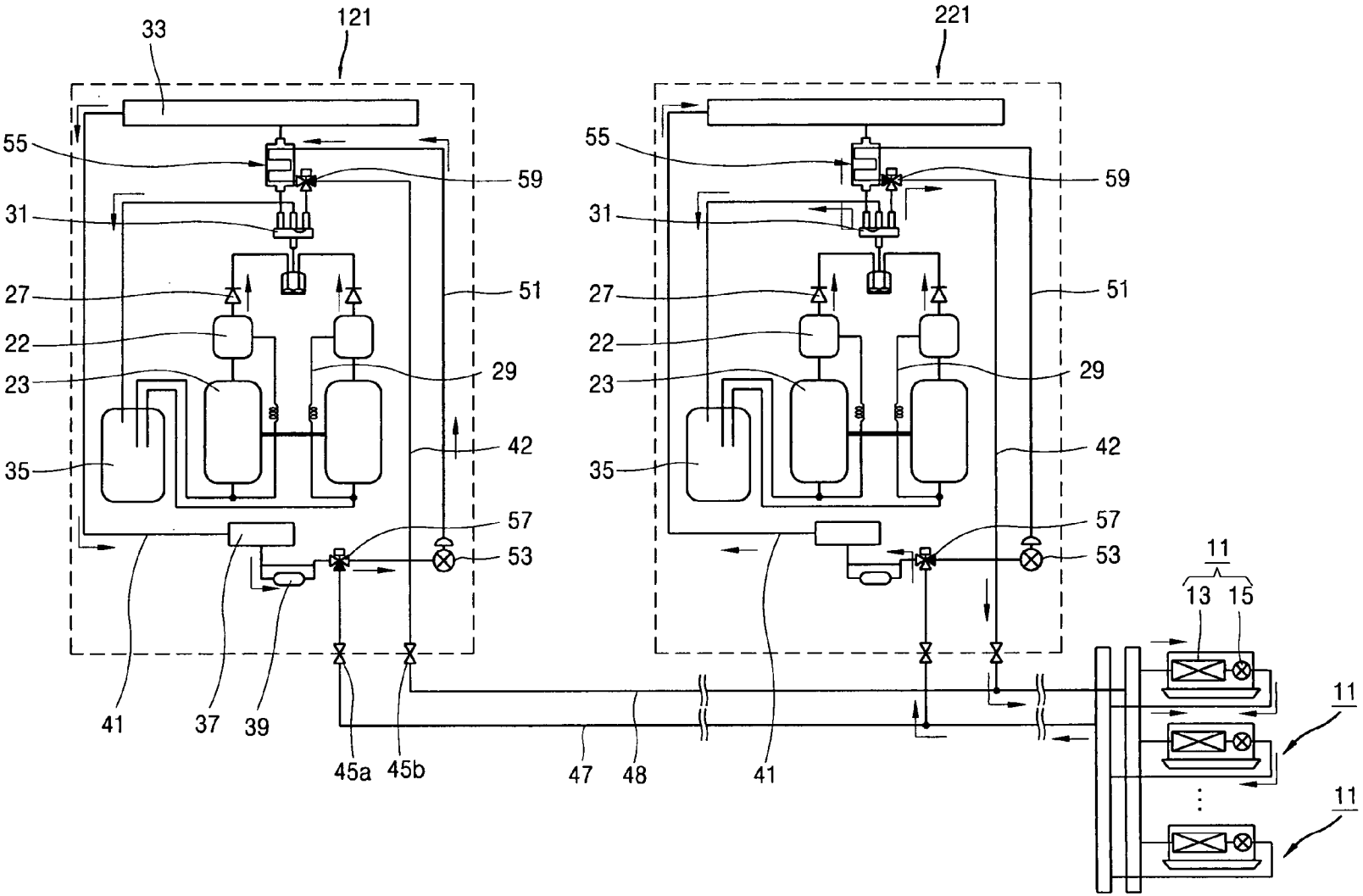
FIG. 5 is a schematic view showing another embodiment of the air conditioner according to the present invention.

Meanwhile, the outdoor unit 121 for performing the defrosting cycle is illustrated at the left side of FIG. 5, and the outdoor unit 221 for performing the heating cycle is illustrated at the right side of FIG. 5.

In the air conditioner according to another embodiment of the present invention, at the time of the defrosting operation for removing frost generated at the outdoor heat exchanger 33, a refrigerant is not leaked to outside of the outdoor units 121 and 221 but circulates in the outdoor units 121 and 221. Accordingly, even if the defrosting operation is performed at one outdoor unit of the plurality of outdoor units, the defrosting operation does not influence to other outdoor units or indoor units, thereby continuing the heating operation of the air conditioner.

In the air conditioner according to another embodiment of the present invention, since the refrigerant which has passed through the outdoor heat exchanger is not introduced into the indoor unit but passes through the outdoor expansion device and the heat exchanging device thus to circulate in the compressor at the time of the defrosting cycle, a noise generated from the indoor unit is prevented and each outdoor unit can separately perform the defrosting operation. According to this, the defrosting operation is performed in a state that the heating cycle is not stopped thus to prevent indoor heating loss.

Also, since the heat exchanging device is provided with a simple structure that the refrigerant which has passed through the outdoor expansion device and the refrigerant discharged from the compressor are heat-exchanged to each other, heat exchange can be smoothly performed without an additional component such as a refrigerant heating device.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An air conditioner comprising an outdoor unit and an indoor unit provided with an indoor heat exchanger and an indoor expansion device, wherein the outdoor unit comprises:

a compressor which compresses a refrigerant;

an outdoor heat exchanger which exchanges heat between a refrigerant and outdoors;

a four-way valve located proximate to the compressor to circulate a refrigerant discharged from the compressor according to a heating cycle or a cooling cycle;

a refrigerant detouring path which detours a refrigerant discharged from the outdoor heat exchanger to the compressor at the time of a defrosting operation;

an outdoor expansion device installed in the middle of the detouring path, which reduces a pressure of a refrigerant which flows in the refrigerant detouring path; and a heat exchanging device installed in the middle of the detouring path which directly exchanges heat between a refrigerant introduced from the outdoor expansion device and a refrigerant discharged from the compressor.

2. The air conditioner of claim 1, wherein the heat exchanging device comprises:

an inlet portion which introduces a refrigerant from the four-way valve;

a heat exchanging portion extending from the inlet portion with an expanded volume, which accommodates the refrigerant detouring path therein; and an outlet portion which discharges a refrigerant which has passed through the heat exchanging portion to the outdoor heat exchanger.

3. The air conditioner of claim 2, wherein the refrigerant detouring path accommodated in the heat exchanging portion of the heat exchanging device is formed as a curved pipe.

4. The air conditioner of claim 1, wherein the refrigerant detouring path is connected to a first refrigerant path which connects the outdoor heat exchanger and the indoor unit by a first three-way valve, and connected to a second refrigerant path which connects the four-way valve and the indoor unit by a second three-way valve.

5. The air conditioner of claim 4, further comprising a receiver which temporarily receives a refrigerant and a drier which removes moisture from a refrigerant, wherein the receipt of the refrigerant and the removal of the moisture occurs between the first refrigerant path and the first three-way valve.

6. The air conditioner of claim 1, wherein the outdoor expansion device is an electronic expansion valve.

7. An outdoor unit for an air conditioner comprising:

a compressor;

an outdoor heat exchanger which exchanges heat between a refrigerant and external air;

a four-way valve located proximate the compressor which circulates a refrigerant according to a heating cycle or a cooling cycle;

a first refrigerant path which connects the outdoor heat exchanger to an indoor unit;

a second refrigerant path which connects the four-way valve to the indoor unit;

a refrigerant detouring paths connected to the first refrigerant path by a first three-way valve and connected to the second refrigerant path by a second three-way valve, which detours a refrigerant at the time of a defrosting cycle;

an outdoor expansion device installed in the middle of the refrigerant detouring path which lowers a pressure of a refrigerant which flows in the refrigerant detouring path; and a heat exchanging device installed between the outdoor expansion device and the second three-way valve, which exchanges heat between a refrigerant discharged from the compressor and a refrigerant which has passed through the outdoor expansion device.

8. The outdoor unit of claim 7, wherein the heat exchanging device comprises:

an inlet portion which introduces a refrigerant from the four-way valve;

a heat exchanging portion extending from the inlet portion with an expanded volume which accommodates the refrigerant detouring path therein; and an outlet portion which discharges a refrigerant which has passed through the heat exchanging portion to the outdoor heat exchanger.

9. The outdoor unit of claim 7, further comprising an accumulator located between at an outlet of the four-way valve and an inlet of the compressor which filters a liquefied refrigerant.

10. An air conditioner comprising:

an indoor unit provided with an indoor heat exchanger and an indoor expansion device; and an outdoor unit comprising:

a compressor which compresses a refrigerant;

an outdoor heat exchanger which exchanges heat between a refrigerant and an outdoors;

a four-way valve located proximate to the compressor, which circulates a refrigerant discharged from the compressor according to either of a heating cycle or a cooling cycle;

a refrigerant detouring path which detours a refrigerant discharged from the outdoor heat exchanger to the compressor at the time of a defrosting operation;

an outdoor expander installed in the middle of the detouring path which reduces a pressure of a refrigerant which flows in the refrigerant detouring path; and a heat exchanger installed in the middle of the detouring path, which directly exchanges heat between a refrigerant introduced from the outdoor expander and a refrigerant discharged from the compressor, said heat exchanger comprising:

an inlet which introduces a refrigerant from the four-way valve;

a heat exchanger extension extending from the inlet portion with an expanded volume to accommodate the refrigerant detouring path therein so which direct heat exchange occurs between a refrigerant passing through the detouring path and a refrigerant introduced through the inlet portion; and an outlet which discharges a refrigerant which has passed through the heat exchanging portion to the outdoor heat exchanger.

11. The air conditioner of claim 10, wherein the refrigerant detouring path is connected to a first refrigerant path which connects the outdoor heat exchanger and the indoor unit by a first three-way valve, and connected to a second refrigerant path which connects the four way valve and the indoor unit by a second there-way valve.

* * * * *

UNITED STATES PATENT AND TRADEMARK OFFICE

CERTIFICATE OF CORRECTION

PATENT NO. : 7,407,002 B2
APPLICATION NO. : 10/720212
DATED : August 5, 2008
INVENTOR(S) : S. Jang et al.

It is certified that error appears in the above-identified patent and that said Letters Patent is hereby corrected as shown below:

At Column 7, Line 53, “paths” should be --path,--.

At Column 8, Line 58, “four way” should be --four-way--.

At Column 8, Line 59, “there” should be --three--.

Signed and Sealed this

Twenty-fourth Day of March, 2009

John Doll

JOHN DOLL
*Acting Director of the United States Patent and Trademark Office*